US005340229A

United States Patent [19]

Schwartzman

[11] Patent Number: 5,340,229

[45] Date of Patent: Aug. 23, 1994

[54] COMBINED MULTI-HOLE PUNCH AND RULER

[75] Inventor: Wayne Schwartzman, Chicago, Ill.

[73] Assignee: McGill Incorporated, Marengo, Ill.

[21] Appl. No.: 34,405

[22] Filed: Mar. 19, 1993

[51] Int. Cl.[5] ..... B26F 1/34

[52] U.S. Cl. ..... 402/4; 402/1; 83/620

[58] Field of Search ..... 402/1, 4; 83/145, 167, 83/620

[56] References Cited

U.S. PATENT DOCUMENTS

| | | | |
|---|---|---|---|
| 1,292,124 | 1/1919 | Stenquist | 402/1 |
| 1,541,188 | 6/1925 | Salt | 83/167 |
| 1,553,378 | 9/1925 | Harper | 83/167 |
| 2,105,233 | 1/1938 | Schade | 402/1 |
| 2,182,544 | 12/1939 | Murrian et al. | 83/145 |
| 2,335,552 | 11/1943 | Unger | 83/145 |
| 2,474,344 | 6/1949 | Carpenter | 83/167 |
| 4,640,451 | 2/1987 | Steiner et al. | 402/1 |

*Primary Examiner*—Hien H. Phan
*Attorney, Agent, or Firm*—Leonard Tachner

[57] ABSTRACT

A multi-hole punch and ruler combination which is especially adapted for storage in and use with a multi-ring binder. The ruler provides a receptacle for receiving the punched out paper chips, as well as a plurality of retention tabs and support tabs for securing the punch in the receptacle in a press fit engagement which may be readily released by the user when desired. The punch comprises relatively low profile upper and lower portions, the lower portion having a defined paper receiving area with front and side edge borders for accurately aligning the edge of the paper relative to the punch members. The lower portion also provides a plurality of cantilevered fingers for receiving the paper edge adjacent the punch holes through which punch members on the upper portion of the punch can protrude and cut or punch holes in the paper sheets received by the punch of the invention. These fingers hold the edge of the paper sheet to separate the sheet from the punch members after the sheet has been punched. The upper and lower portions of the punch are hinged in a press fit relation. The ruler has two conventional straight edge scales, one on each side or edge of the punch. One such scale provides a plurality of loose leaf ring holes so that the combined punch and ruler can be supported on the rings of a multi-ring binder.

10 Claims, 4 Drawing Sheets

COMBINED MULTI-HOLE PUNCH AND RULER

BACKGROUND OF THE INVENTION

1. Field of the Invention

The present invention relates generally to the field of stationery supplies, and more specifically to a combined multi-hole punch and ruler that is especially adapted for attachment to a ring binder for portable use.

2. Prior Art

It is clearly advantageous to have a three hole punch available wherever one might use a three ring binder, so that any papers generated or received, which do not already have the proper holes aligned and spaced for placing such paper in a three ring binder, can easily be punched for doing so. Unfortunately, most three hole punches are heavy and bulky and therefore not suitable for portability and especially portability in a convenient manner, without adding any appreciable weight or bulk that a user must carry in order to provide such capability outside the office or schoolroom. A three hole punch suitable for use in conjunction with a three ring binder should satisfy a number of important criteria relating to size, weight and shape in order to meet the requirements for portability and convenience. For one thing, it should be relatively flat, so that when installed in a three ring binder, it does not significantly affect the number of sheets that can also be stored in a three ring binder and so that it does not prevent the three ring binder from being closed. In addition, it must have a means for attachment to the three ring binder, preferably in the same manner as the sheets therein, namely by providing three holes properly spaced to mount the three hole punch on the rings of the binder where they can be secured thereto. In addition, it must be light so that it does not add significantly to the weight burden of the three ring binder and the overall burden to the user who may carry several such binders or other paraphernalia when traveling out of the office or schoolroom. Furthermore, it must be easy to use. In this regard, it should preferably not require removal of the three hole punch from the three ring binder in order to place one or more sheets of paper in the punch and activate the punch for creating the binder size holes in the papers. None of the prior art known to the applicant discloses a three hole punch which simultaneously meets all of these criteria. Accordingly, there appears to be an ongoing need for such a three hole punch, which can be particularly advantageous for use outside the office or schoolroom and have all of the aforementioned advantages.

SUMMARY OF THE INVENTION

The present invention comprises a combined three hole punch and ruler which meets all of the aforementioned criteria, namely, in its preferred embodiment it is made of a lightweight plastic material; it is designed to be attached to the rings of a three ring binder; it is of a relatively flat configuration when closed, thereby not interfering with other contents in the binder; and it is easy to use without requiring its removal from the three ring binder prior to use. However, it is configured so that either the combined ruler and punch can be removed easily or the punch can be separated from the ruler and used outside the binder and then replaced by reconnection to the ruler for storage therein when not in use.

In a preferred embodiment of the invention disclosed herein, both the punch and ruler of the combined apparatus of the invention, are made of a relatively rigid injection-molded plastic such as general purpose styrene and ABS. The ruler is preferably made of a transparent form of styrene and the punch is preferably being made of an opaque form of ABS. The ruler provides a receptacle for receiving the paper chips punched out of the paper, as well as a plurality of retention tabs and support tabs for securing the punch in the receptacle in a press fit engagement which may be readily released by the user when desired. The punch comprises relatively low profile upper and lower portions, the lower portion having a defined paper receiving area with front and side edge borders for accurately aligning the edge of the paper relative to the punch members. The lower portion also provides a plurality of cantilevered fingers for receiving the paper edge adjacent the punch holes through which punch members on the upper portion of the punch can protrude and cut or punch holes in the paper sheets received by the punch of the invention. These fingers hold the edge of the paper sheet to separate the sheet from the punch members after the sheet has been punched. The upper and lower portions of the punch are hinged in a press fit releasable relation so that they can be separated if desired, after removing the punch from the underlying ruler receptacle- The ruler has two conventional scales, one on each side or edge of the punch, terminating in straight edge surfaces for drawing straight lines and for measuring along a straight line. One such scale provides a plurality of loose leaf ring holes so that the combined punch and ruler can be supported on the rings of a multi-ring binder.

The novelty of the present invention resides in its unique structure, permitting the integration of a three hole punch and is ruler in a releasable engaging relation that can be installed in a three ring binder while still affording a relatively thin profile, lightweight, ease of use and a low cost, readily manufactured configuration. The details of this unique structure will be described hereinafter in conjunction with the accompanying figures which illustrate a preferred embodiment of the invention.

OBJECTS OF THE INVENTION

It is therefore a principal object of the present invention to provide a combined multi-hole punch and ruler, especially adapted for use in conjunction with a multi-ring binder and for installation therein for ease of transportability and use outside the office or schoolroom.

It is another object of the present invention to provide a combined multi-hole punch and ruler which may be readily manufactured at low cost using simple injection molding techniques.

It is still an additional object of the present invention to provide a combined multi-hole punch and ruler which is of a very low profile, so that it may be installed in a multi-ring binder without significantly altering the capacity of the three ring binder to store documents therein.

It is still an additional object of the present invention to provide a combined multi-hole punch and ruler adapted for being press fit to one another and releasable from one another, whereby the punch can be separated from the ruler for separate use if so desired.

It is an additional object of the present invention to provide a combined multi-hole punch and ruler, the punch being releasably affixed to a receptacle in the ruler and having relatively low profile upper and lower portions hingedly connected to one another so that they may be opened for receiving the edges of documents to be punched and then closed for actually punching the documents, the lower portion of the punch being readily removed from the receptacle of the ruler to permit removal of the waste contained therein, after a plurality of paper sheets have been punched thereby.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 3:
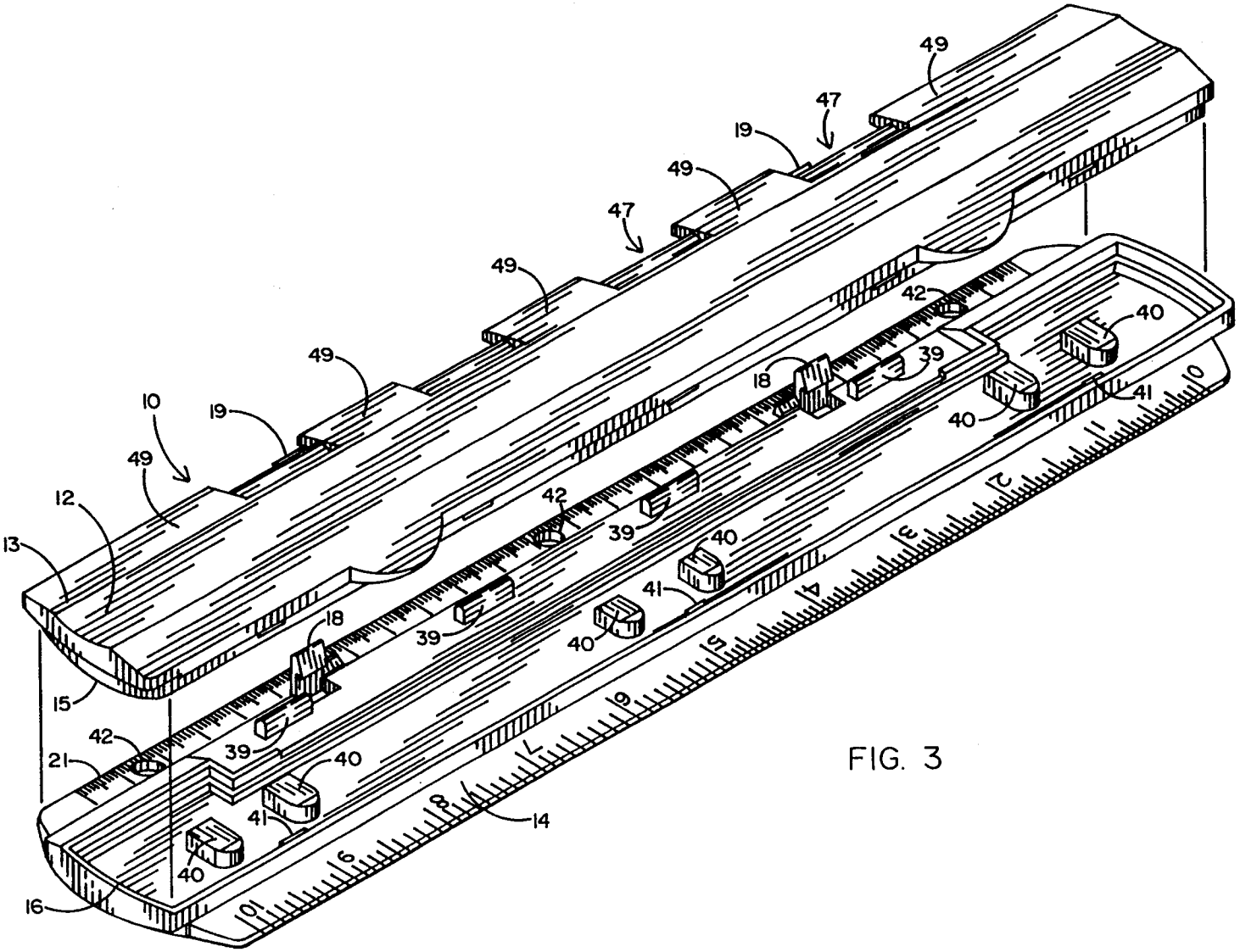
FIG. 3 is an isometric exploded view of the preferred embodiment of the invention, wherein the punch is separated from the underlying ruler.

Referring now to the accompanying drawings, it will be seen that a three hole punch 10 in accordance with the present invention comprises a punch 12 and a ruler 14. The punch 12 has an upper portion 13 and a lower portion 15 which are normally hingedly attached to one another. The ruler 14 is of an elongated, relatively flat configuration having parallel scales (i.e., English and metric units, respectively) on the opposing edges thereof, namely scales 17 and 21 seen best in FIG. 3. However, the ruler also has a receptacle 16 of a generally rectangular configuration, extending the full length of the ruler between the scaled edges thereof. With in the receptacle 16 of the ruler 14, there is provided a plurality of paper support platforms 40, the purpose and function of which will be described hereinafter in more detail. Receptacle 16 catches the punched paper waste each time a sheet of paper is punched. In addition, the ruler 14 provides a plurality of hinge supports 39, as well as a pair of retention tabs 18, the latter being adjacent the scale 21, as well as being in proximity to a pair of the aforementioned hinge supports 39. It can also be seen in FIG. 3 that the scale 21 provides three loose leaf ring holes 42 which are of conventional standard size and spacing to permit attachment of the ruler 14 to a conventional three ring binder. Of course it will be understood that the size and spacing of the holes 42 can be varied to accommodate variations in three ring binders. Furthermore, it will be understood that while the present invention is disclosed as being adaptable to connection to three ring binders, it can also be readily adapted to connection to binders which use more or less than three rings by altering the spacing and number of the holes 42 to accommodate such variations in the ring binder. The ruler also provides a plurality of support tabs 41 which as will be seen hereinafter, are designed to mate with a corresponding plurality of tab recesses 43 in the lower portion 15 of the punch 12.

The punch 12, as previously indicated comprises an upper portion 13 and a lower portion 15. The upper portion 13 is a generally rectangular member having a plurality of punch members 24 extending perpendicularly and aligned with a corresponding plurality of punch holes 26 in the lower portion 15 of the punch 12. Upper portion 13 of the punch also comprises a plurality of ribs 30 extending laterally across the width of the upper portion for increasing the strength thereof. The upper portion 13 also comprises a pair of overhang portions 36, which are rounded in shape and are adapted to overhang the lower portion 15, thereby providing easy finger access for separating the upper and lower portions around their respective hinges. The upper portion 13 of the punch 12 also comprises a plurality of hinge pins 44, each such pin being suspended between a pair of downwardly facing flanges 45 in an open region 47, each such region being boarded by a pair of rectangular flanges 49.

Figure 1:
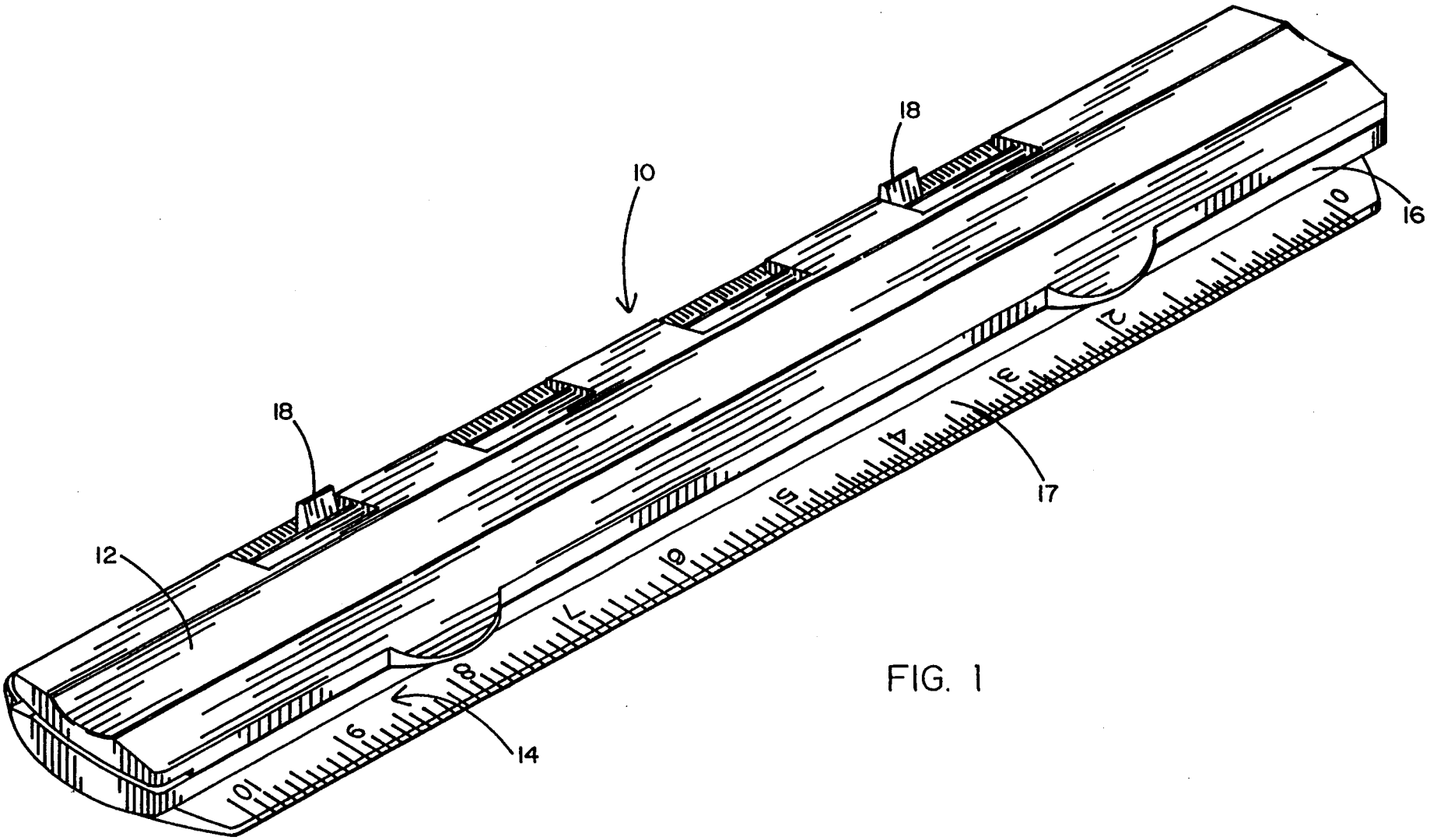
FIG. 1 is an isometric view of the present invention showing the preferred embodiment thereof in its fully assembled and closed configuration, adapted for storage in a three ring binder.
Figure 2:
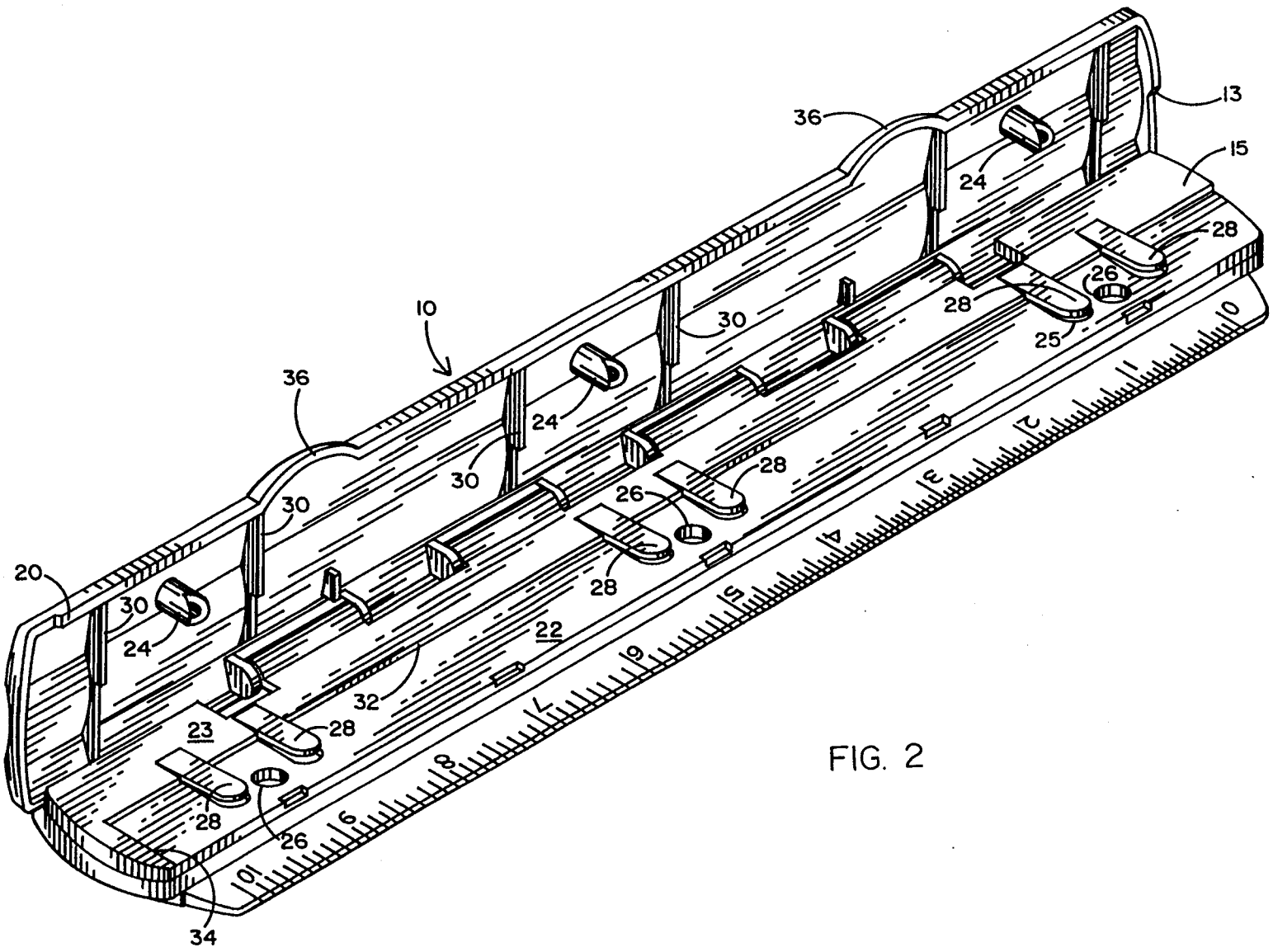
FIG. 2 is an isometric view of the present invention showing the upper portion of the punch thereof being swung on its hinges away from the lower portion thereof for receiving one or more sheets of paper for punching therein.
Figure 4:
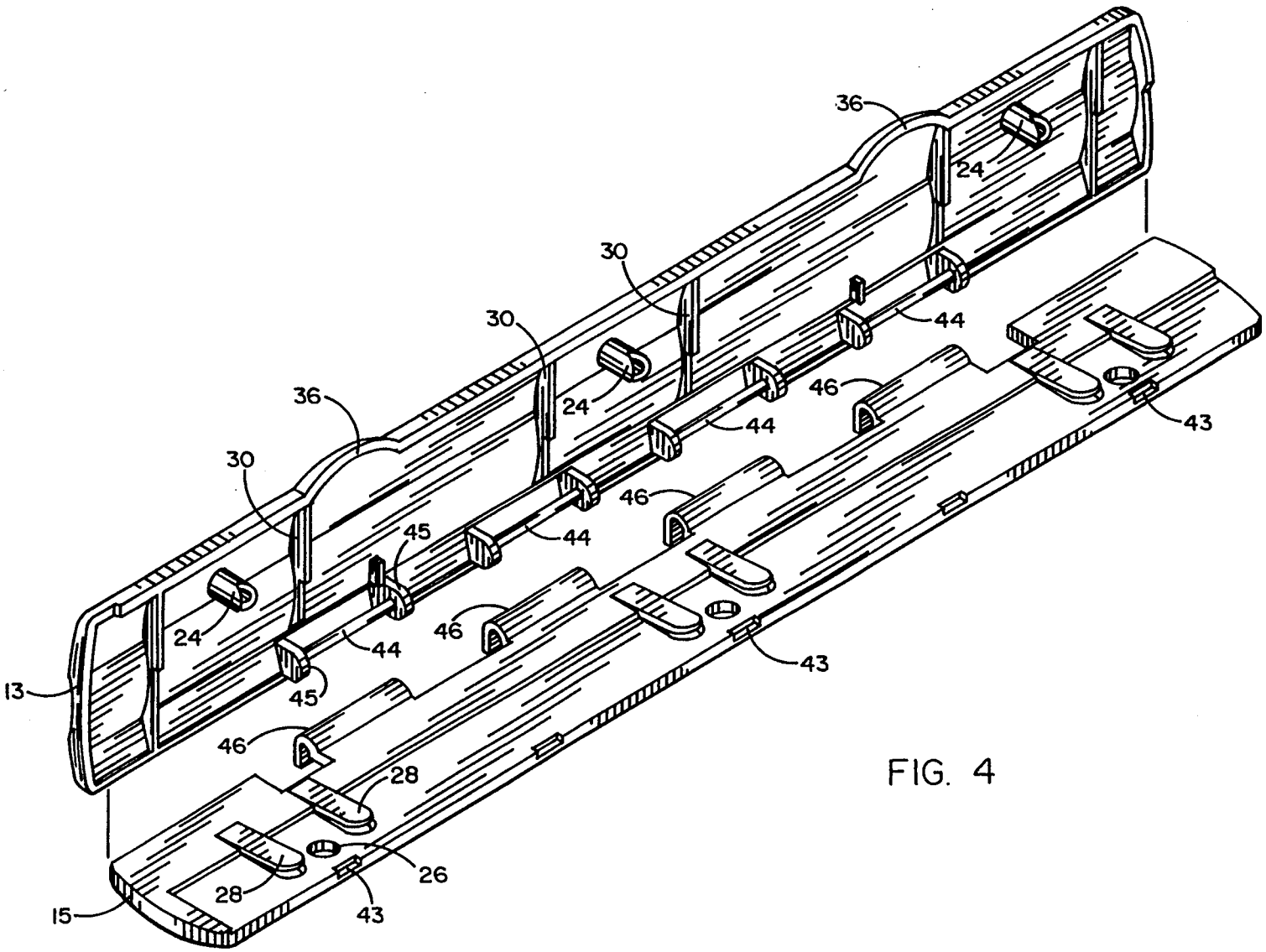
FIG. 4 is an isometric partially exploded view of the punch of the present invention showing the upper portion of the punch separated from the lower portion thereof.

The lower portion 15 of the punch 12, provides a corresponding plurality of hinges 46, having a partial U-shaped cross-section and adapted for partially encircling the corresponding hinge pins 44 of the upper portion 13 of the punch 12, when the upper and lower portions are mated. Lower portion 15 also provides a paper receiving area 22, defined by a front edge border 32 and a side edge border 34. The paper receiving area 22 is slightly recessed from the remaining surface of the lower portion of the punch, thereby defining an accurately shaped corner region for receiving the edge of a rectangular shaped sheet of paper. Also seen in FIGS. 2 and 4, are the fingers 28, a pair of which are cantilevered out from the relatively elevated surface 23 in suspended spaced relation to the underlying paper receiving area 22, above corresponding apertures 25 in spaced relation to the underlying paper support platforms 40 of the ruler 14. Fingers 28 separate the paper sheet from the punch members 24 after the paper has been punched.

Interconnection of the upper portion 13 and lower portion 15 shown separated in FIG. 4, is accomplished by inserting the hinge pins 44 into the interior surface of the hinges 46, forming the configuration shown in FIG. 2 and automatically aligning the punch members 24 in the upper portion 13 with the punch holes 26 in the lower portion. Closing the upper portion, relative to the lower portion by rotation about their respective hinge members, causes the punch members to penetrate the upper surface of the punch holes, thereby punching through one or more sheets of paper that may be positioned above the punch holes 26 and under the fingers 28. The waste resulting from such punching is captured in the receptacle 16 which may be emptied after separating the ruler 14 from the punch 12.

Interconnection of the assembled punch 12 with the receptacle 16 of the ruler 14, is accomplished by first nesting the punch into the receptacle and then closing the punch and applying pressure to the top portion until the punch snaps into place, thereby securing the lower portion of the punch 12 in locking engagement with the ruler 14 and specifically within the receptacle 16 thereof.

Thus, it will be understood that what has been disclosed herein comprises a novel multi-hole punch and ruler combination which is especially adapted for storage in and use with a multi-ring binder. It will also be understood that the unique structure of the present invention is significantly more convenient and suitable for portable use outside the office or schoolroom because of its low profile, lightweight and ease of use, as well as its provision for attachment to the rings of a ring binder. Furthermore, it will be understood that despite its lightweight and low cost, and ease of portability, the three hole punch of the present invention is just as effective in accurate three hole punch processing of paper sheets as any larger, more conventional desk-type three hole punch.

Those having ordinary skill in the art to which the present invention pertains, will now, as a result of the applicant's teaching herein, perceive various modifications and additions which may be made to the invention. By way of example, the precise shape and dimension thereof, as well as the number of binder rings with which the present invention is designed to mate, can be readily altered. Furthermore, the precise manner of locking the lower portion of the punch with the underlying receptacle of the ruler, may be readily altered without deviating from the inventive concepts disclosed herein. Accordingly, all such modifications and additions are deemed to be within the scope of the invention which is to be limited only by the claims appended hereto and their equivalents.

We claim:

1. A combined paper punch and ruler comprising:

a ruler having a receptacle for receiving a lower portion of a punch and for collecting punched waste paper;

a punch having a unitary upper portion having a plurality of integral punch members, said punch also having a unitary lower portion having a plurality of integral punch holes positioned for receiving respective said punch members;

said lower portion and said ruler having means for releasably securing said punch to said receptacle of said ruler for selective emptying of said receptacle of said punched waste paper;

said upper and lower portions being hingedly attached to one another for insertion of at least one paper sheet therebetween for being punched and for removal of said sheet thereafter;

said ruler having at least one hole for being attached to a ring of a ring binder.

2. The combined paper punch and ruler recited in claim 1 wherein each said ruler, said upper portion and said lower portion is an injection-molded plastic member.

3. The combined paper punch and ruler recited in claim 1 wherein said upper and lower portions comprise means for being detached from one another.

4. The combined paper punch and ruler recited in claim 1 further comprising a pair of integral cantilevered fingers on said lower portion adjacent each said punch hole, one such finger on each side of said hole for receiving an edge of a paper sheet to be punched for separating such sheet from said punch member after said sheet has been punched.

5. The combined paper punch and ruler recited in claim 1 wherein said lower portion further comprises a recessed region defined by precisely perpendicular edges forming a border for aligning a paper sheet relative to said lower portion.

6. A multi-hole paper punch comprising:

an elongated, unitary punching member having an integral plurality of punches;

an elongated, unitary punch hole member having an integral plurality of punch holes for cooperating with said punches;

said punching member and said punch hole member being hingedly interconnected for opening to receive a sheet of paper for punching holes therein and for closing into substantially parallel fixed abutting relation for storage of said paper punch; and a ruler-shaped base member adapted for receiving said paper punch in releasable engageable therewith and having a receptacle for collecting punched waste paper from said sheet of paper.

7. The paper punch recited in claim 6 wherein said base member comprises a plurality of spaced holes for securing said base member to a multi-ring binder.

8. The paper punch recited in claim 6 wherein each said punch hole member, said punching member and said base member is an injection-molded plastic member.

9. The paper punch recited in claim 6 further comprising means for aligning a paper sheet for accurate placement of punch apertures thereon.

10. The paper punch recited in claim 6 further comprising a plurality of cantilevered fingers on said punch hole member, one such finger being positioned on each of two sides of each said punch hole for separating said sheet of paper from said punches after said sheet is punched.

* * * * *